United States Patent [19]

Williams

[11] 4,108,406

[45] Aug. 22, 1978

[54] RAIL CAR SAFETY REFLECTOR

[76] Inventor: David M. Williams, 501 W. Third St., Apt. 708, Davenport, Iowa 52801

[21] Appl. No.: 869,623

[22] Filed: Jan. 16, 1978

[51] Int. Cl.[2] ..... B61L 5/18

[52] U.S. Cl. ..... 246/474; 40/587; 340/49; 350/97

[58] Field of Search ..... 246/473 R, 474, 111, 246/118, 125, 292, 293, 477, 479, 482, 483, 484; 40/51, 129 C, 138; 340/49, 121, 127, 130, 138, 142; 350/97, 99, 266, 273; 116/51, 52, 54, 130, 132; 280/289 R; 296/97 B, 97 C, 97 G

[56] References Cited

U.S. PATENT DOCUMENTS

| | | | |
|---|---|---|---|
| 1,955,966 | 4/1934 | Kingsley | 340/49 |
| 2,925,584 | 2/1960 | Bonanno | 116/52 |

*Primary Examiner*—Trygve M. Blix
*Assistant Examiner*—Reinhard J. Eisenzopf
*Attorney, Agent, or Firm*—Clarence A. O'Brien; Harvey B. Jacobson

[57] ABSTRACT

A passively-actuated visual warning reflector device for providing a "flashing", oscillating, or fluctuating visual signal, the invention is readily adapted to be mounted to a moving vehicle, particularly the side of a train car, to warn of the presence of the vehicle at route intersections and crossings. The present reflector device is comprised of a reflective or luminous substrate member attached to a surface of either a vehicle or a stationary structure, an apertured disk member being mounted in superimposed relation to the reflective member for swinging movement relative thereto, thereby partially obscuring varying portions of the reflective member on movement of the disk member to provide the effect of an "on-off" light signal. The disk member is provided with circumferential flanges which catch air currents and cause the disk member to swing relative to the reflective member.

8 Claims, 5 Drawing Figures

RAIL CAR SAFETY REFLECTOR

BACKGROUND OF THE INVENTION

1. Field of the Invention

The present invention relates to reflective warning devices which are useful for alerting motorists to the presence of other vehicles and road hazards.

2. Description of the Prior Art

The prior art has previously provided warning devices of both an active and passive nature which act to warn of the presence of a dangerous condition, particularly a road hazard associated with moving or stationary vehicles. Active visual devices particularly include lights disposed on a vehicle or on a stationary object intended to warn of a dangerous condition, it having been previously appreciated that a flashing light is more effective in alerting observers to the presence of potential dangers. However, active visual devices must be operated by a source of power such as a battery or the like which causes the light to repetitively flash on and off. As is obvious, such active devices require a substantial amount of energy for operation and are also costly. Passive visual warning devices, particularly reflective devices wherein light from vehicle headlights or other sources are reflected to observers, are also known in the art. Such reflective devices have even been caused to provide a flashing effect by intermittently obscuring at least portions of a reflective surface. For example, LaLonde, in U.S. Pat. No. 3,528,721, causes a flashing effect of a reflective device by mounting the device against the wheel of a bicycle so that rotation of the wheel causes the reflective device to oscillate. Priest, in U.S. Pat. No. 3,551,024, discloses a flashing retroreflective reflector in which a convex lens focuses incoming light on a retroreflective medium, the device being oscillated such that retroreflection is obtained only when incoming light is incident along the axis of the lens. Hammer, in U.S. Pat. No. 2,869,424, provides a passive warning signal device wherein portions of a reflective surface are intermittently obscured by spring mounted masking plates, the masking plates being oscillative due to motion of the vehicle carrying the reflective device. Klaenhammer, et al., in U.S. Pat. No. 4,023,888, provides a reflective structure having portions thereof intermittently obscured by a swinging masking member, the swinging member being driven by a motor. However, the prior art has not provided a passive visual warning reflector device capable of producing a "flashing" visual signal on mounting of the device to either a stationary or potentially movable object. A free-swinging portion of the present device has means formed thereon which are actuable by air currents to be operable both when the structure on which the device is mounted is moving and also when the structure is stationary, as long as air is circulating about the device when the structure is stationary.

SUMMARY OF THE INVENTION

The present invention provides a visual warning reflector device for providing a "flashing" visual signal, the present structure being passively actuated by air currents induced by the motion of a vehicle on which the device is mounted or by normal air currents incident on the device when said device is mounted to either a temporarily or permanently stationary surface. The present reflector device particularly provides a periodically varying reflection of light incident thereon, such as the light provided by vehicle headlights, to afford a visual warning signal to an observer. The present device particularly comprises a reflective or luminous member which is attached to the surface of either a vehicle or a stationary structure, the device further comprising an apertured disk member mounted in superimposed relation to the reflective member and adapted for swinging movement relative thereto. The swinging disk member periodically interrupts light reflecting from the reflective member, thereby providing the effect of an "on-off" light signal. The disk member of the invention is particularly provided with a central aperture which allows reflection from the reflective member through said disk member even when the disk member is at rest. The disk member is further provided with circumferential flanges which catch air currents and causes the disk member to swing relative to the reflective member, such air currents being either induced by the motion of an object, such as a vehicle, to which the present device is mounted, or are naturally occurring.

Accordingly, it is an object of the present invention to provide a passively-actuated visual warning reflector device capable of reflecting lights from a remote source of light and which will provide a "flashing" or fluctuating reflected light signal as a result of periodic partial occlusion of a reflective portion of the device by a passive, relatively movable portion of said device.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
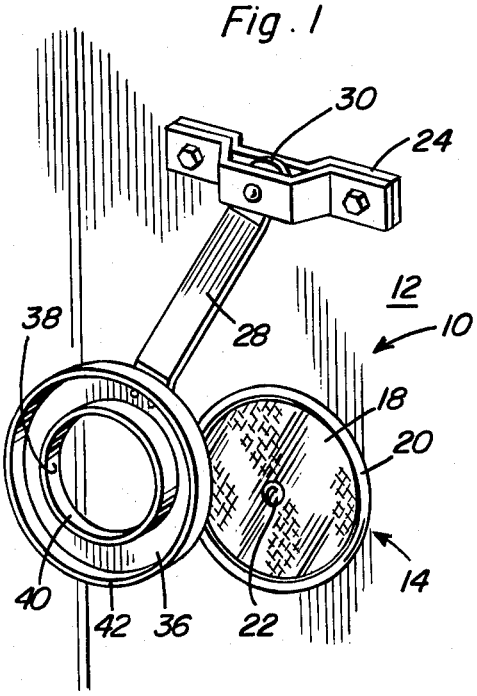
FIG. 1 is a perspective view of a preferred embodiment of the invention in operational configuration.
Figure 2:
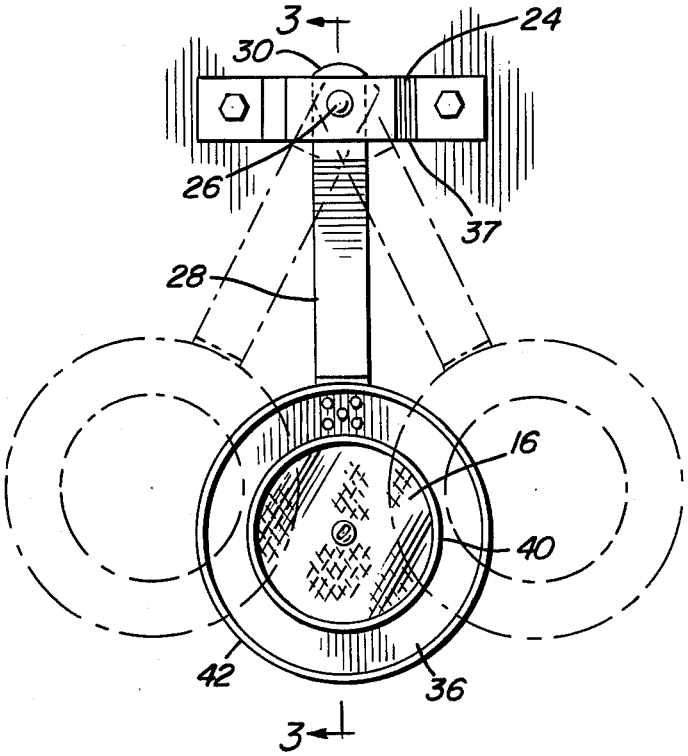
FIG. 2 is a front elevational view illustrating the position of the swinging portion of the device at rest, the maximum side-to-side positions of the swinging portion of the device being shown in phantom.
Figure 3:
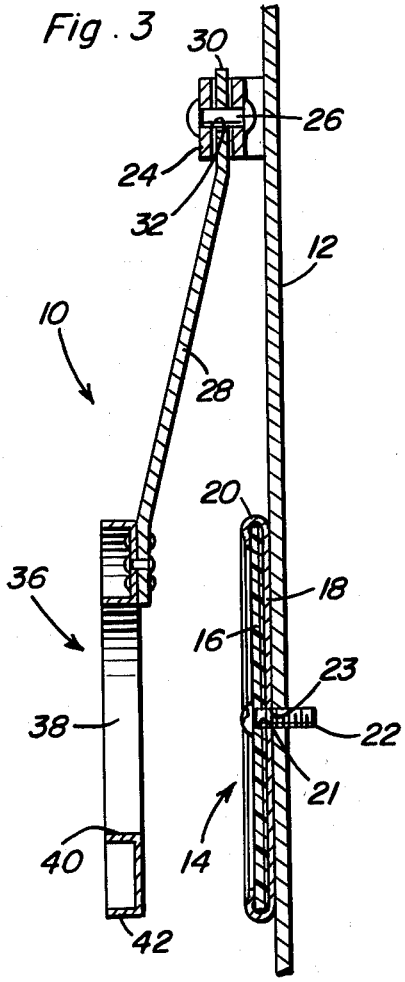
FIG. 3 is a sectional view taken along line 3—3 of FIG. 2.

Referring now to the drawings and particularly to FIGS. 1, 2 and 3, a visual warning device according to the invention is seen generally at 10 to comprise a reflector plate 14 and a disk member 36 adapted to move across the face of the reflector plate 14 to periodically obscure varying portions of the surface of the plate 14, thereby to cause a "flashing" or fluctuating visual signal to be perceived by an observer. The visual warning device 10 is seen to be mounted on a surface 12, which surface 12 can comprise a base plate which is itself mounted on a surface of a vehicle or even a stationary warning sign structure. However, it is preferred to mount the several portions of the visual warning device 10, including the reflector plate 14, directly on the surface 12, the surface particularly comprising an exterior side wall surface of a railroad freight car, or the like.

Although the invention is particularly intended to provide railroad freight cars with visual warning devices of a passive nature such that such freight cars can be readily seen at night at unguarded railroad grade crossings, it should be understood that the present visual warning device 10 can also be used on other vehicles and even on stationary objects, particularly when such stationary objects are openly exposed to normal air currents.

The reflector plate 14 is seen to be comprised of a layer 16 of reflective material backed by a base 18, the perimetric edges of the base 18 being formed into an annular crimp 20 to fasten the layer 16 onto said base 18. A mounting screw 22 can conveniently be fitted through aligned apertures 21 and 23 in the layer 16 and base 18, respectively, in order to secure the reflector plate 14 to the surface 12. It should be understood that the reflector plate 14 can be configured other than as shown in the drawings, the layer 16 of reflective material being particularly replaceable with a layer of a luminous material. The layer 16 can readily comprise a planar glass member or faceted reflective members such as are well-known in the art. Alternatively, the reflector plate 14 could simply comprise a layer of reflective paint painted directly onto the surface 12. The reflector plate 14 is intended only to provide a reflective or light-emitting surface on a localized portion of the surface 12. It can readily be appreciated that the reflector plate 14 could comprise an active source of light, without departing from the scope of the invention, the remaining portions of the visual warning device 10 being passive as aforesaid.

A bracket 24 is attached to the surface 12 in a position surmounting the reflector plate 14, the bracket 24 having a pin 26 extending substantially horizontally between shoulder portions of the bracket 24, the pin 26 receiving an angled first end 30 of an arm member 28 for swinging movement of said arm member 28 on the pin 26. The angled first end 30 of the arm member 28 is provided with an aperture 32 through which the pin 26 is received for free swinging movement of said arm member 28. The opposite end of the arm member 28 comprises an angled free end 34, the plane of which free end 34 is substantially parallel to the plane of the angled first end 30. The disk member 36 is mounted to the angled free end 34 of the arm member, the disk member 36 and arm member 28 being free to swing from the bracket 24. The disk member 36 is thereby positioned in superimposed relation to the reflector plate 14 to swing in an oscillatory fashion across the face of the reflector plate 14, thereby at least partially occluding at least portions of the reflective material 16 on such swinging movement of the disk member 36 across said reflector plate 14. As can be particularly seen in FIG. 2, shoulder portions 37 of the bracket 24 substantially limit the degree of freedom of the arm member 28 to cause the disk member 36 to be restrained in its travel across the face of the reflector plate 14 such that the disk member 36 does not move any significant distance beyond a partially occluding relation to the reflector plate 14.

The disk member 36 is provided with an aperture 38 formed centrally therein, the aperture 38 preferably comprising at least 50% of the planar surface area of the disk member 36. The planar surface area of the disk member 36 preferably is greater than the planar surface area of the layer 16 of reflective material of the reflector plate 14. Accordingly, when the disk member 36 is at rest or is in a fully superimposed position over the reflector plate 14, at least a substantial portion of the layer 16 of reflective material of the reflector plate 14 can be observed through the aperture 38 to provide a reflective warning signal to an observer. Movement of the disk member 36 in swinging relation to the relatively stationary reflector plate 14 periodically interrupts the reflection of light from the layer 16 to provide a visual warning signal which is preceived by an observer to be a "flashing" light. Therefore, the swinging movement of the disk member 36 relative to the reflector plate 14 provides the effect of an "on-off" light signal.

The disk member 36 is further provided with an inner perimetric flange 40 disposed about the periphery of the aperture 38, an outer perimetric flange 42 being similarly disposed about the periphery of the disk member 36. The flanges 40 and 42 preferably open outwardly of the surface 12 in order that air currents incident on the device 10 can be more efficiently "caught" by the flanges 40 and 42 to cause the disk member 36 to move relative to the reflector plate 14. As can readily be appreciated, when the visual warning device 10 is mounted on the side of a vehicle, the motion of the vehicle relative to standing or moving air provides a relative motion between the disk member 36 and the air, the flanges 40 and 42 having a pressure exerted thereagainst by the air to cause said disk member 36 to move relative to the reflector plate 14. Even when a vehicle on which the visual warning device 10 is mounted is caused to be at rest, normal air currents incident on the device 10 exert a pressure against the flanges 40 and 42 to cause the disk member 36 to swing relative to the reflector plate 14 to provide the "flashing" visual signal intended by the invention.

Figure 4:
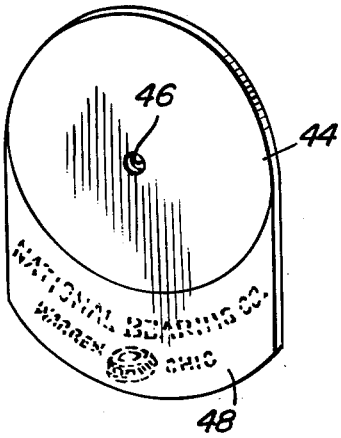
FIG. 4 is a perspective view of a sponsor's plate usable with the invention; and, FIG. 5 is a side elevational view in partial section of the device having the sponsor's plate of FIG. 4 mounted therewith.
Figure 5:
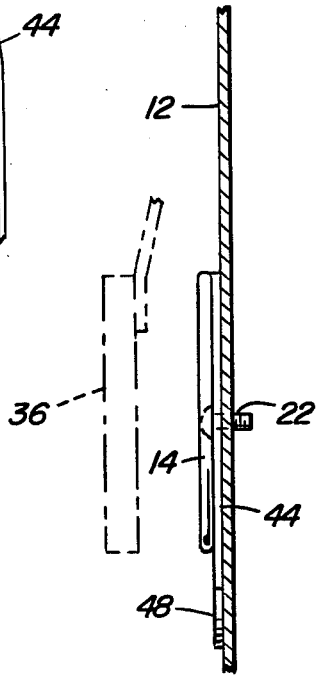

As seen in FIG. 4, the present device 10 can readily be modified to provide an advertising function, a sponsor plate 44 being mountable between the reflector plate 14 and the surface 12 as shown in FIG. 5. The mounting screw 22 used to mount the reflector plate 14 to the surface 12 can be similarly utilized to mount the sponsor plate 44 beteen said reflector plate 14 and said surface 12, an aperture 46 being provided centrally in the sponsor plate 44 to receive the mounting screw 22 therethrough. An extended portion 48 of the sponsor plate 44 extends outwardly into an exposed position from that portion of the sponsor plate 44 surmounted by the reflector plate 14, an advertising message being disposed on said extended portion 48.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A passive visual warning device adapted to be mounted to a surface, comprising:

means mounted on the surface for directing light therefrom;

an arm member;

bracket means mounted on the surface in surmounting relation to the first-mentioned means for mounting the arm member at one end thereof for swinging movement relative to the first-mentioned means;

a cover member mounted on a free end of the arm member and disposed in superimposed relation to the first-mentioned means, the cover member at least partially occluding the first-mentioned means in at least certain positions relative thereto during swinging movement of the arm member and thus the cover member relative to said first-mentioned means; and, means mounted on the cover member for catching air currents to cause the arm member and the cover member to swing relative to the first-mentioned means.

2. The device of claim 1 wherein the cover member has an aperture disposed therein, the first-mentioned means being at least partially visible through the cover member on full superimposition of said cover member on said first-mentioned means.

3. The device of claim 2 wherein the cover member is circular and the aperture is centrally disposed therein, the last-mentioned means comprising annular flange members disposed about inner and outer peripheries of the cover member.

4. The device of claim 1 wherein the first-mentioned means comprises a light reflective member.

5. The device of claim 1 wherein the first-mentioned means comprises a luminous member.

6. The device of claim 1 wherein the last-mentioned means comprises at least one flange member disposed on the cover member.

7. The device of claim 1 and further comprising a plate member extending from the first-mentioned means for providing a surface on which commercial messages are disposed.

8. The device of claim 1 wherein the arm member is provided with end portions angled with respect to the major body portion of the arm member, the planes in which the end portions lie being substantially parallel to each other, one end portion of the arm member being mounted by the bracket means and the other end portion having the cover member mounted thereto, the cover member thereby being caused to be disposed outwardly of the surface in surmounting relation to the first-mentioned means.

* * * * *